US009628902B2

(12) United States Patent
Chou

(10) Patent No.: US 9,628,902 B2
(45) Date of Patent: Apr. 18, 2017

(54) PASSIVE RADIATOR STRUCTURE

(71) Applicant: MEILOON INDUSTRIAL CO., LTD., Tao Yuan (TW)

(72) Inventor: Yeh-Feng Chou, Tao Yuan (TW)

(73) Assignee: MEILOON INDUSTRIAL CO., LTD., Taoyuan (TW)

( * ) Notice: Subject to any disclaimer, the term of this patent is extended or adjusted under 35 U.S.C. 154(b) by 0 days.

(21) Appl. No.: 14/860,939

(22) Filed: Sep. 22, 2015

(65) Prior Publication Data

US 2017/0085980 A1 Mar. 23, 2017

(51) Int. Cl.

| | |
|---|---|
| ***H04R 1/00*** | (2006.01) |
| ***H04R 1/28*** | (2006.01) |
| ***H04R 7/04*** | (2006.01) |

(52) U.S. Cl.

CPC ..... *H04R 1/2834* (2013.01); *H04R 7/04* (2013.01); *H04R 2307/201* (2013.01); *H04R 2307/207* (2013.01)

(58) Field of Classification Search

CPC .. H04R 1/2834; H04R 7/04; H04R 2307/207; H04R 2307/201

See application file for complete search history.

(56) References Cited

U.S. PATENT DOCUMENTS

| | | | | |
|---|---|---|---|---|
| 7,528,509 | B2 * | 5/2009 | Ueda | H04R 9/025 310/13 |
| 2004/0075351 | A1 * | 4/2004 | Ueda | B06B 1/045 310/81 |
| 2004/0131221 | A1 * | 7/2004 | Takayama | H04R 7/20 381/398 |
| 2006/0153416 | A1 * | 7/2006 | Kaneda | H04R 9/02 381/396 |
| 2009/0139794 | A1 * | 6/2009 | Silver | H04R 7/20 181/171 |
| 2010/0172535 | A1 * | 7/2010 | Huang | H04R 7/20 381/404 |
| 2014/0009008 | A1 * | 1/2014 | Li | B06B 1/045 310/28 |

* cited by examiner

*Primary Examiner* — Tuan D Nguyen
(74) *Attorney, Agent, or Firm* — Jackson IPG PLLC; Demian K. Jackson

(57) ABSTRACT

A passive radiator structure includes an integrally formed diaphragm structure and a surround suspension. The diaphragm structure includes a diaphragm, a frame, and a web-like spider having a plurality of suspension arms integrally extended to between the diaphragm and the frame. The surround suspension has a radially inner gluing edge adhered to a radially inner location of the diaphragm structure around the diaphragm, and a radially outer gluing edge adhered to a radially outer location of the diaphragm structure around the frame. The surround suspension and the web-like spider of the diaphragm structure form two suspension elements for stably supporting the diaphragm, enabling minimized irregular shaking and reduced weight of the diaphragm, as well as reduced sound distortion, increased compliance and upgraded efficiency of the passive radiator structure.

7 Claims, 4 Drawing Sheets

PASSIVE RADIATOR STRUCTURE

FIELD OF THE INVENTION

The present invention relates to a passive radiator structure, and more particularly to a passive radiator structure that has integrally formed frame, web-like spider and diaphragm, and can therefore has reduced sound distortion, upgraded efficiency and increased compliance, and be easily manufactured at lowered cost.

BACKGROUND OF THE INVENTION

In a general speaker enclosure design, in addition to the provision of a sound outputting speaker in the enclosure, a passive radiator would usually be further mounted at a proper position in the enclosure to increase the low-frequency efficiency of the speaker when it outputs sound. That is, the low-frequency sound output by the speaker can be effectively extended through the resonance of the diaphragm of the passive radiator to enable good bass effect.

The use of a passive radiator enables better resonance of the sound wave output by a speaker and improvement of the bass quality of the speaker enclosure. However, the conventional passive radiator includes only one surround suspension, which tends to result in irregular shake of the diaphragm and cause the problem of serious sound distortion. In addition, the conventional passive radiator usually requires a relatively heavy diaphragm to thereby have reduced efficiency.

It is therefore tried by the inventor to develop an improved passive radiator structure that overcomes the problems of the conventional passive radiator, including irregularly shaking diaphragm, sound distortion and low efficiency.

SUMMARY OF THE INVENTION

A primary object of the present invention is to provide an improved passive radiator structure that has a diaphragm structure integrally formed of a frame, a diaphragm, and a web-like spider having a plurality of suspension arms extended to between the frame and the diaphragm; and a surround suspension glued to around the diaphragm structure. The surround suspension has a radially inner gluing edge adhered to a radially inner location of the diaphragm structure around the diaphragm, and a radially outer gluing edge adhered to a radially outer location of the diaphragm structure around the frame, so that the diaphragm is stably supported without irregularly shaking easily and can have reduced weight, enabling the passive radiator structure to have reduced sound distortion, increased compliance, upgraded efficiency, and lowered production cost.

To achieve the above and other objects, the passive radiator structure according to a preferred embodiment of the present invention includes a diaphragm; a frame externally located around the diaphragm; a web-like spider having a plurality of suspension arms, which are extended to between the diaphragm and the frame and are circumferentially equally spaced from one another by a predetermined distance to stably connect the frame to the diaphragm, such that a diaphragm structure is integrally formed of the web-like spider, the diaphragm and the frame; and a surround suspension glued to around the diaphragm structure. Therefore, the diaphragm is supported by both of the web-like spider and the surround suspension without irregularly shaking easily and can have reduced weight, which in turn enables reduced sound distortion, increased compliance, and upgraded efficiency of the passive radiator structure.

In the preferred embodiment, the diaphragm is flat and round in shape.

In the preferred embodiment, the surround suspension has a convex, semicircular cross section.

In the preferred embodiment, the surround suspension has a radially inner peripheral edge and a radially outer peripheral edge that respectively form an inner gluing edge and an outer gluing edge of the surround suspension. The inner gluing edge is adhered to a radially inner location of the diaphragm structure around the diaphragm, and the outer gluing edge is adhered to a radially outer location of the diaphragm structure around the frame.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with a preferred embodiment thereof and by referring to the accompanying drawings.

Figure 1:
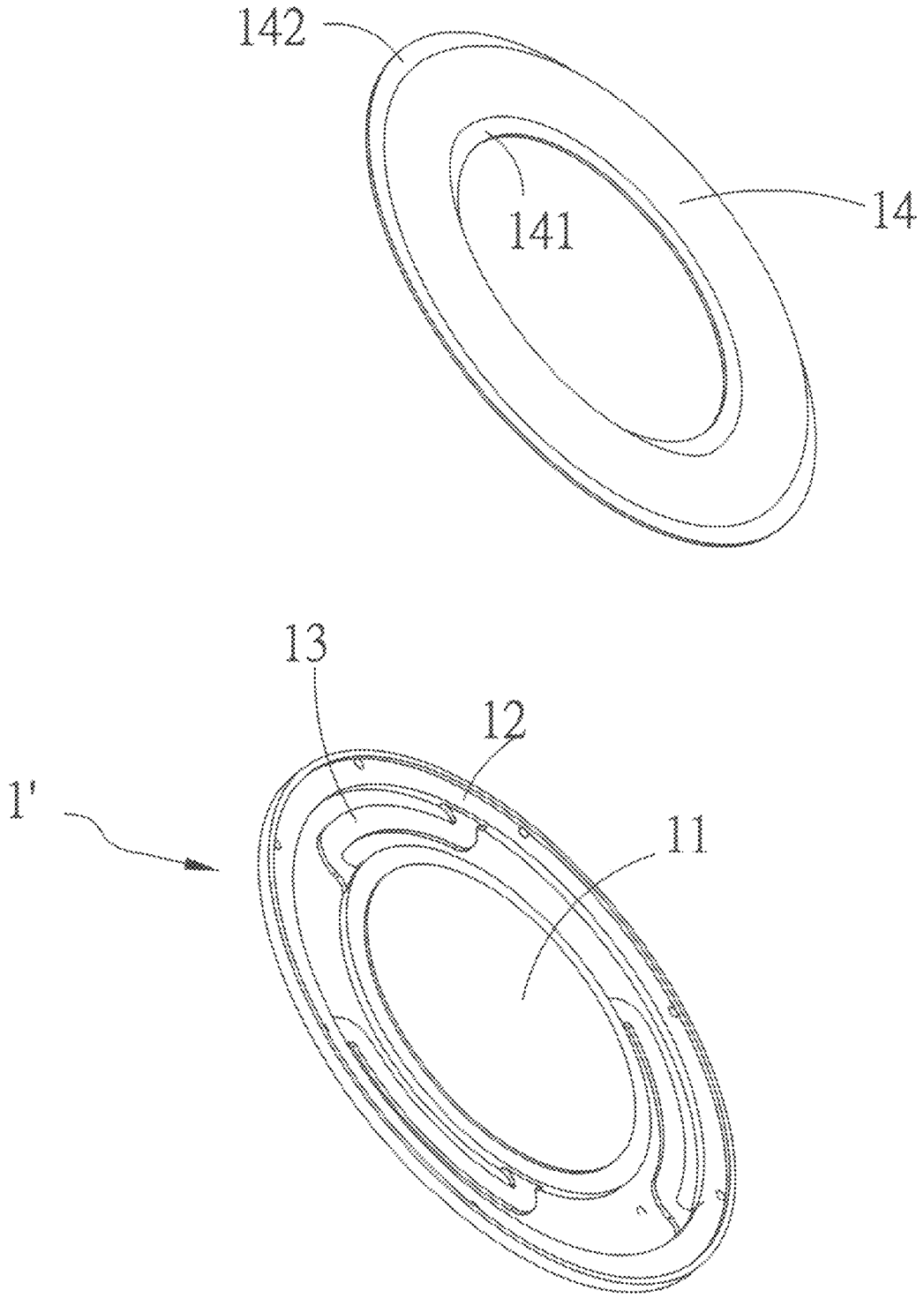
FIG. 1 is an exploded perspective view of a passive radiator structure according to a preferred embodiment of the present invention.
Figure 2:
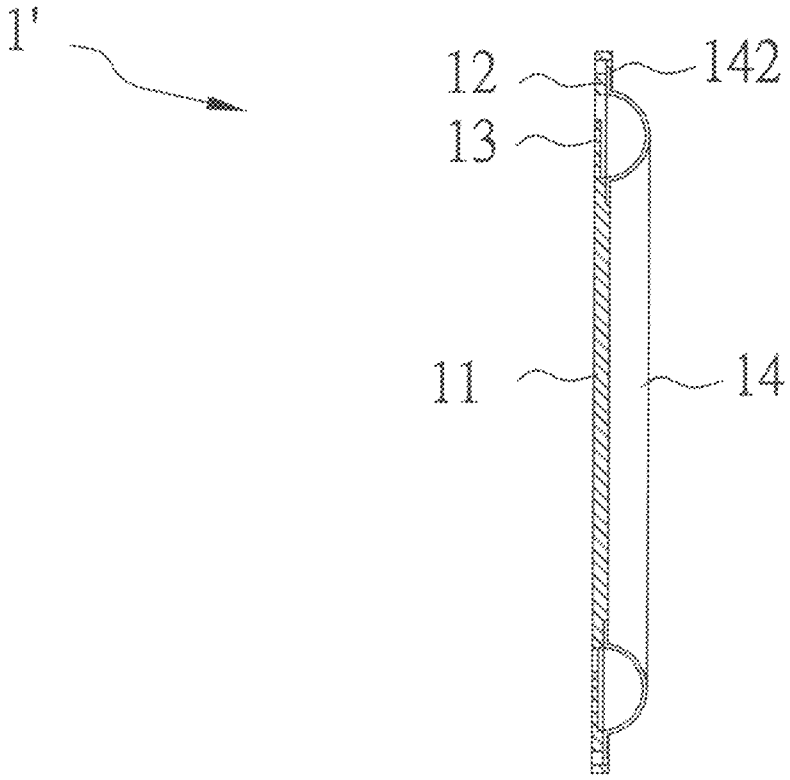
FIG. 2 is a partially sectioned perspective view of the passive radiator structure of the present invention in an assembled state.
Figure 3:
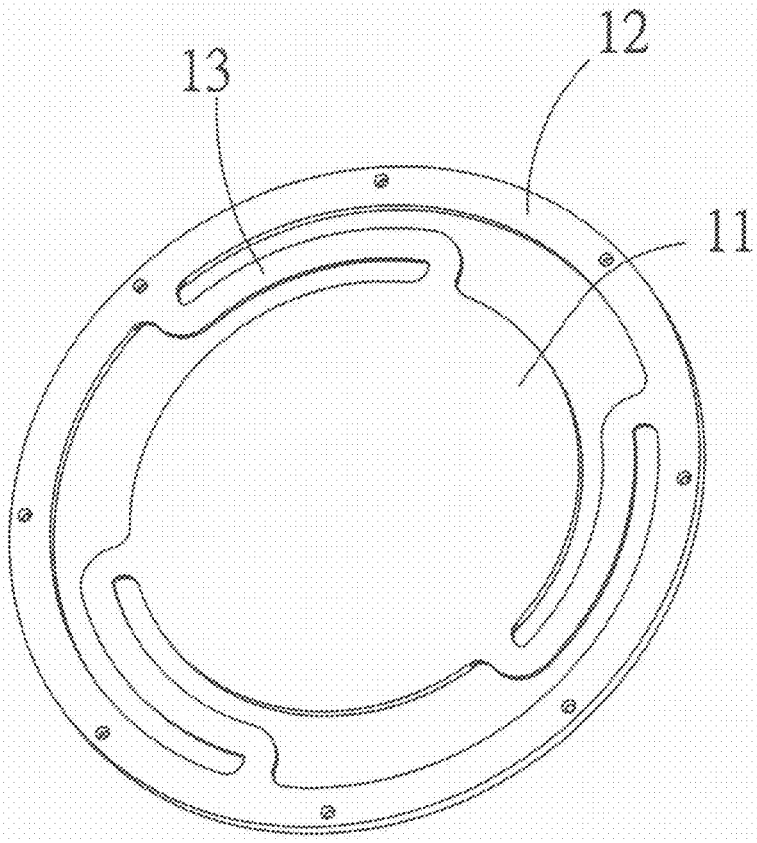
FIG. 3 is a bottom view of the passive radiator structure of the present invention in an assembled state.
Figure 4:
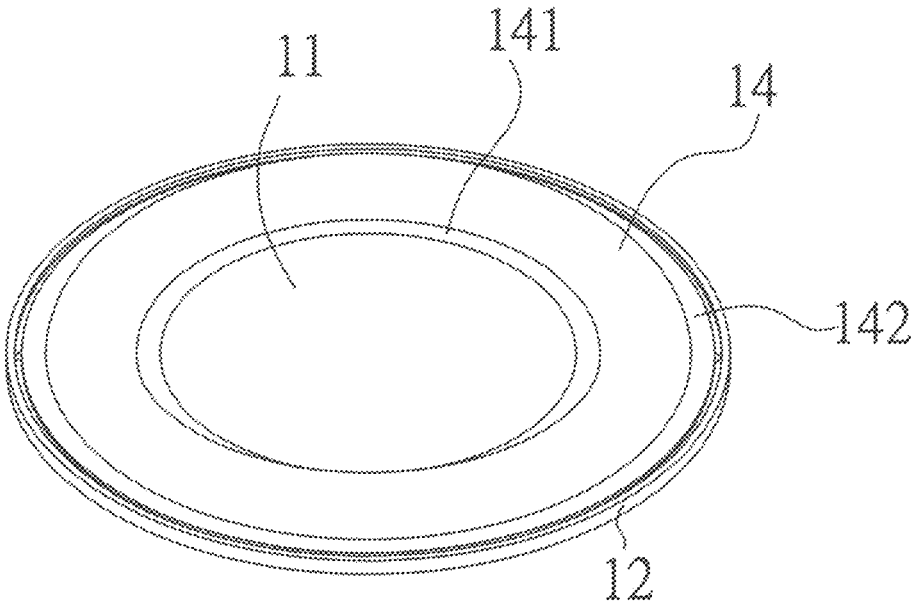
FIG. 4 is a top view of the passive radiator structure of the present invention in an assembled state.

Please refer to FIG. 1. A passive radiator structure according to a preferred embodiment of the present invention includes an integrally formed diaphragm structure 1' and a surround suspension 14. The diaphragm structure 1' includes a diaphragm 11, a frame 12 and a spider 13 that are integrally formed with one another. The spider 13 is a web-like structure including a plurality of suspension arms.

The frame 12 is externally located around the diaphragm 11.

The web-like spider 13 is extended to between the diaphragm 11 and the frame 12. The suspension arms of the web-like spider 13 are circumferentially equally spaced from one another by a predetermined distance to stably connect the diaphragm 11 to the frame 12, so as to form the diaphragm structure F.

The surround suspension 14 is coupled to the diaphragm structure 1' to complete the passive radiator structure of the present invention. With this arrangement, the passive radiator structure of the present invention has two suspension elements, namely, the surround suspension 14 and the web-like spider 13, which together prevent the diaphragm 11 from irregularly shaking easily and accordingly, reduce the sound distortion of the passive radiator structure. Further, since two suspension elements are used to provide the diaphragm 11 with an enhanced supporting effect, the web-like spider 13 and the surround suspension 14 can be made of softer materials and give the passive radiator structure increased compliance and upgraded efficiency.

In the illustrated preferred embodiment, the diaphragm 11 of the passive radiator structure 1' is flat and round in shape.

In the illustrated preferred embodiment, the surround suspension 14 has a convex semicircular cross section.

In the illustrated preferred embodiment, the surround suspension 14 has a radially inner peripheral edge and a radially outer peripheral edge that form an inner gluing edge 141 and an outer gluing edge 142, respectively. The inner gluing edge 141 of the surround suspension 14 is adhered to a radially inner location of the diaphragm structure 1' around the diaphragm 11, and the outer gluing edge 142 of the surround suspension 14 is adhered to a radially outer location of the diaphragm structure 1' around the frame 12. By gluing the surround suspension 14 to the diaphragm structure 1' in the above-described manner, the surround suspension 14 and the integrally formed web-like spider 13 of the diaphragm structure 1' form two suspension elements of the passive radiator structure to stably support the diaphragm 11, preventing the diaphragm 11 from irregularly shaking easily and accordingly, reducing the sound distortion of the passive radiator structure. When two suspension elements are provided, the diaphragm 11 can be better supported, the web-like spider 13 and the surround suspension 14 can be made of softer materials, and the passive radiator structure can have increased compliance and upgraded efficiency.

In the illustrated preferred embodiment, the diaphragm 11, the frame 12 and the web-like spider 13 are integrally formed with one another.

The diaphragm 11, the frame 12 and the web-like spider 13 can be integrally formed through injection molding technology, enabling the passive radiator structure to be manufactured at lowered production cost.

The passive radiator structure of the present invention is characterized in that the diaphragm structure 1' is integrally formed with the web-like spider 13 extended and connected to between the diaphragm 11 and the frame 12; and that the surround suspension 14 is glued at radially inner and outer gluing edges 141, 142 to around the diaphragm 11 and the frame 12, respectively, of the diaphragm structure 1' to enable quick production of the passive radiator structure; and that the surround suspension 14 and the integrally formed web-like spider 13 form two suspension elements to stably support the diaphragm 11, preventing the diaphragm 11 from irregularly shaking easily and accordingly, reducing the sound distortion of the passive radiator structure. When two suspension elements are provided, the diaphragm 11 can be better supported, the web-like spider 13 and the surround suspension 14 can be made of softer materials, and the passive radiator structure can have increased compliance and upgraded efficiency. When the passive radiator structure has increased compliance, the diaphragm 11 thereof can be reduced in weight to achieve the purpose of upgraded efficiency and reduced resonant frequency.

With the above arrangements, the passive radiator structure of the present invention has the following advantages:

(1) Reduced distortion of sound: When the surround suspension 14 is glued to the diaphragm structure 1', the surround suspension 14 and the integrally formed web-like spider 13 together form two suspension elements in the passive radiator structure, preventing the diaphragm 11 from irregularly shaking easily and accordingly, reducing the sound distortion of the passive radiator structure;

(2) Increased compliance and upgraded efficiency: Since the provision of two suspension elements enables better support of the diaphragm 11, the web-like spider 13 and the surround suspension 14 can be made of softer materials to thereby enable increased compliance and upgraded efficiency of the passive radiator structure;

(3) Lowered production cost: Unlike the conventional passive radiator that is manufactured by gluing a frame, a spider and a diaphragm to one another, the passive radiator structure of the present invention has a diaphragm 11, a frame 12 and a web-like spider 13 that are integrally formed with one another through injection molding of a nylon material to thereby effectively lower the production cost of the passive radiator structure; and (4) Reduced diaphragm weight: The passive radiator structure of the present invention adopts two suspension elements of the surround suspension 14 and the web-like spider 13 to provide the diaphragm 11 with even better supporting effect, which in turn enables reduced sound distortion of the passive radiator structure as well as manufacturing of the surround suspension 14 and the web-like spider 13 with softer materials to increase the compliance and upgrade the efficiency of the passive radiator structure. When the compliance is increased, the diaphragm 11 can be made lighter in weight to thereby achieve the purpose of upgraded efficiency and adjusted resonant frequency.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A passive radiator structure, comprising:

a diaphragm;

a frame externally located around the diaphragm;

a web-like spider having a plurality of suspension arms extending between the diaphragm and the frame and circumferentially equally spaced from one another by a predetermined distance and connecting the frame to the diaphragm, such that a single, integral diaphragm structure is integrally formed of the web-like spider, the diaphragm and the frame; and a surround suspension glued over the single, integral diaphragm structure; whereby the diaphragm is supported by both of the web-like spider and the surround suspension.

2. The passive radiator structure as claimed in claim 1, wherein the diaphragm is flat and round in shape.

3. The passive radiator structure as claimed in claim 1, wherein the surround suspension has a convex semicircular cross section.

4. The passive radiator structure as claimed in claim 1, wherein the surround suspension has a radially inner peripheral edge and a radially outer peripheral edge that respectively form an inner gluing edge and an outer gluing edge of the surround suspension; the inner gluing edge being adhered to a radially inner location of the diaphragm structure around the diaphragm, and the outer gluing edge being adhered to a radially outer location of the diaphragm structure around the frame.

5. The passive radiator structure of claim 1, wherein the surround suspension is glued around the diaphragm and around the frame such that the diaphragm is supported by both of the web-like spider and frame and the surround suspension.

6. The passive radiator structure of claim 1, wherein the single, integral diaphragm structure extends in one plane and wherein the surround suspension extends outside the one plane.

7. The passive radiator structure of claim 1, wherein the surround suspension covers at least the frame and the web-like spider of the single, integral diaphragm structure.

* * * * *